US005341791A

United States Patent [19]

Shafer

[11] Patent Number: 5,341,791

[45] Date of Patent: Aug. 30, 1994

[54] BOW SIGHT APPARATUS

[75] Inventor: Gary J. Shafer, R.R. 3, Box 167, Edinburg, Va. 22824

[73] Assignee: Gary J. Shafer, Edingburg, Va.

[21] Appl. No.: 88,374

[22] Filed: Jul. 9, 1993

[51] Int. Cl.[5] ..... F41G 1/467

[52] U.S. Cl. ..... 124/87; 33/265

[58] Field of Search ..... 124/23.1, 24.1, 86, 124/87, 88; 33/265

[56] References Cited

U.S. PATENT DOCUMENTS

| | | | |
|---|---|---|---|
| 2,351,103 | 6/1944 | Brown | 124/87 X |
| 3,997,974 | 12/1976 | Larson | 33/265 |
| 4,166,324 | 9/1979 | Carollo et al. | 33/265 X |
| 4,170,071 | 10/1979 | Mann et al. | 33/265 |
| 4,473,959 | 10/1984 | Saltzman | 33/265 |
| 4,704,800 | 11/1987 | Stinson | 33/265 |
| 4,977,677 | 12/1990 | Troescher | 33/265 |
| 5,092,052 | 3/1992 | Godsey | 33/265 |
| 5,131,153 | 6/1992 | Seales | 33/265 |

*Primary Examiner*—Randolph A. Reese
*Assistant Examiner*—John A. Ricci

[57] ABSTRACT

An illuminated sighting structure is arranged to include a sighting tube arranged for mounting relative to an archery bow. The sighting tube includes a first end spaced from a second end, the second end having a chemiluminescent ring, with a chemiluminescent sphere mounted within a rod directed into the sighting tube adjacent the first end. A modification of the invention includes illumination structure arranged to enhance illumination of the sphere and ring.

2 Claims, 4 Drawing Sheets

FIG. 5
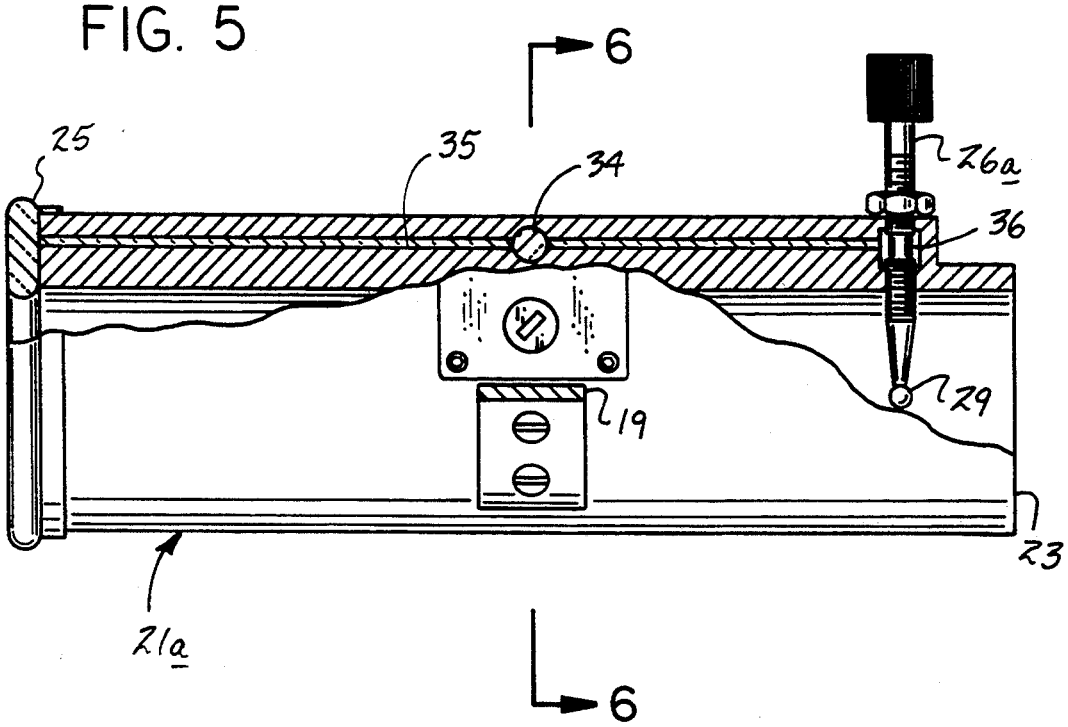
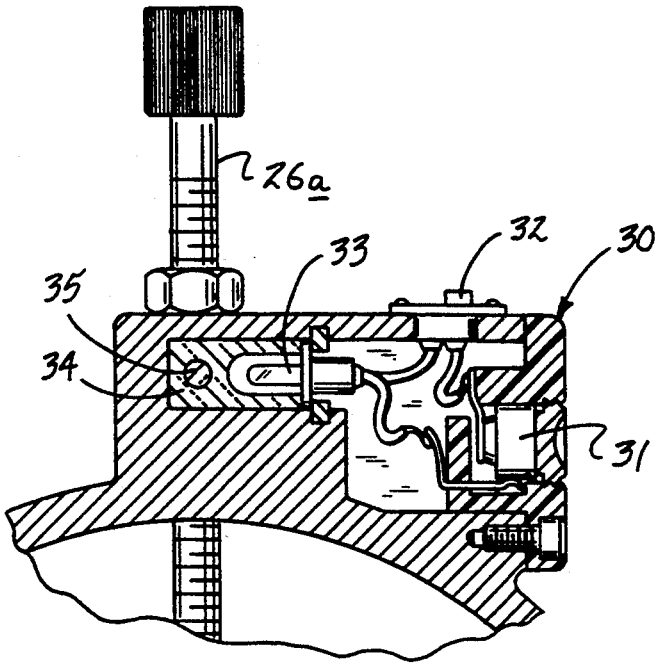
FIG. 6

BOW SIGHT APPARATUS

BACKGROUND OF THE INVENTION

1. Field of the Invention

The field of invention relates to bow sighting apparatus, and more particularly pertains to a new and improved bow sighting apparatus wherein the same is arranged to include a sight tube having an illumination sphere and ring to enhance sighting in use of the organization.

2. Description of the Prior Art

Bow sighting apparatus of various types are indicated in the prior art and exemplified by the U.S. Pat. Nos. 5,025,565; 4,974,576; and 4,967,478.

The instant invention attempts to overcome deficiencies of the prior art by providing a sight tube arranged for adjustable mounting relative to a bow body, including an illumination ring in cooperation with an illumination sphere and in this respect, the present invention substantially fulfills this need.

SUMMARY OF THE INVENTION

In view of the foregoing disadvantages inherent in the known types of bow sight apparatus now present in the prior art, the present invention provides a bow sight apparatus wherein the same includes a sighting tube having a first end to include a bow sighting illumination sphere in adjacency thereto, with a second end including an illumination ring. As such, the general purpose of the present invention, which will be described subsequently in greater detail, is to provide a new and improved bow sight apparatus which has all the advantages of the prior art bow sight apparatus and none of the disadvantages.

To attain this, the present invention provides an illuminated sighting structure arranged to include a sighting tube arranged for mounting relative to an archery bow. The sighting tube includes a first end spaced from a second end, the second end having a chemiluminescent ring, with a chemiluminescent sphere mounted within a rod directed into the sighting tube adjacent the first end. A modification of the invention includes illumination structure arranged to enhance illumination of the sphere and ring.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bow sight apparatus which has all the advantages of the prior art bow sight apparatus and none of the disadvantages.

It is another object of the present invention to provide a new and improved bow sight apparatus which may be easily and efficiently manufactured and marketed.

It is a further object of the present invention is to provide a new and improved bow sight apparatus which is durable and reliable construction.

An even further object of the present invention is to provide a new and improved bow sight apparatus which is susceptible of a low cost of manufacture with regard to both materials and labor, and which accordingly is then susceptible of low prices of sale to the consuming public, thereby making such bow sight apparatus economically available to the buying public.

Still yet another object of the present invention is to provide a new and improved bow sight apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration of a modified sight tube structure.

FIG. 6 is an orthographic view, taken along the lines 6—6 of FIG. 5 in the direction indicated by the arrows.

DESCRIPTION OF THE PREFERRED EMBODIMENT

Figure 1:
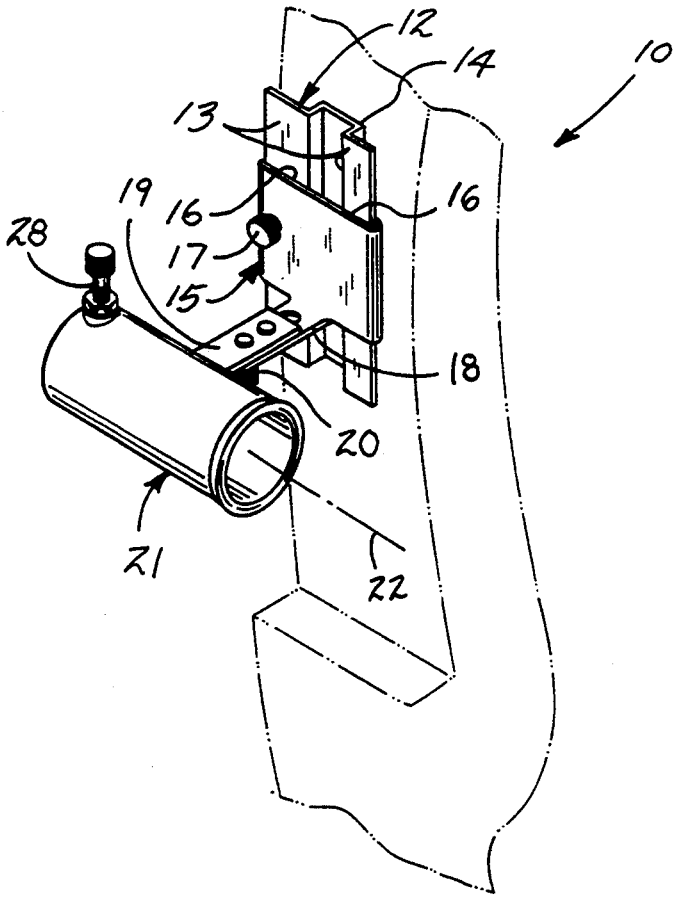
FIG. 1 is an isometric illustration of the invention.
Figure 2:
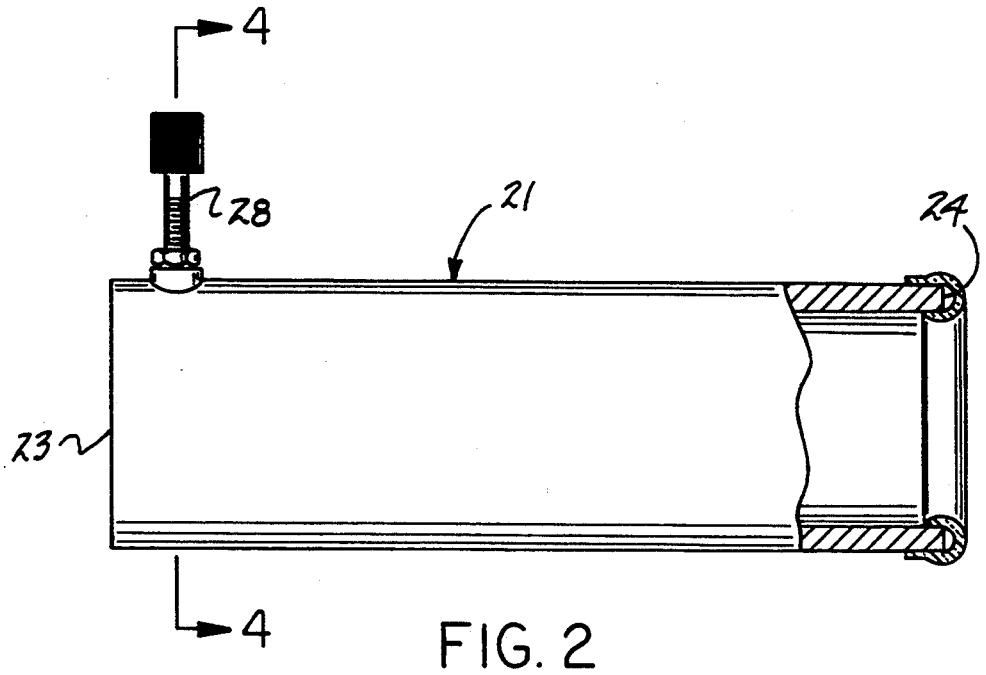
FIG. 2 is an orthographic side view of the invention, partially in section.
Figure 3:
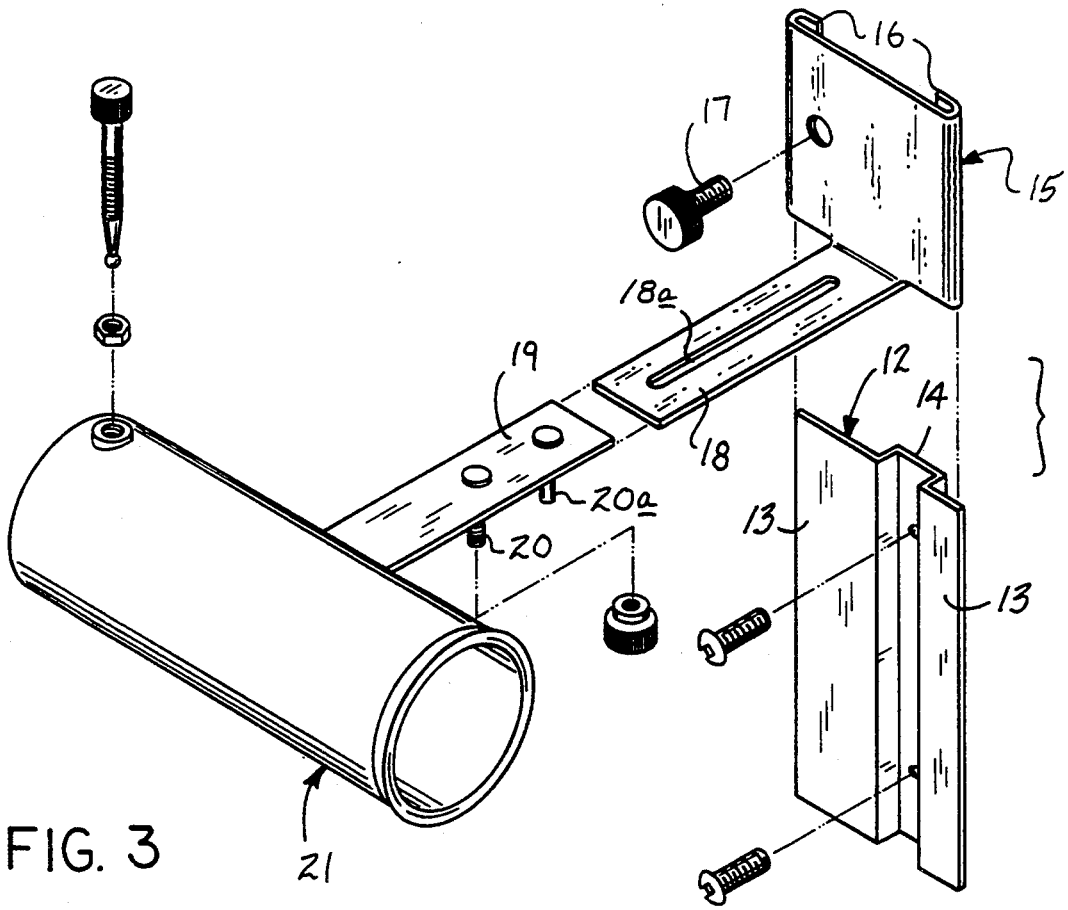
FIG. 3 is an isometric exploded view of the invention.
Figure 4:
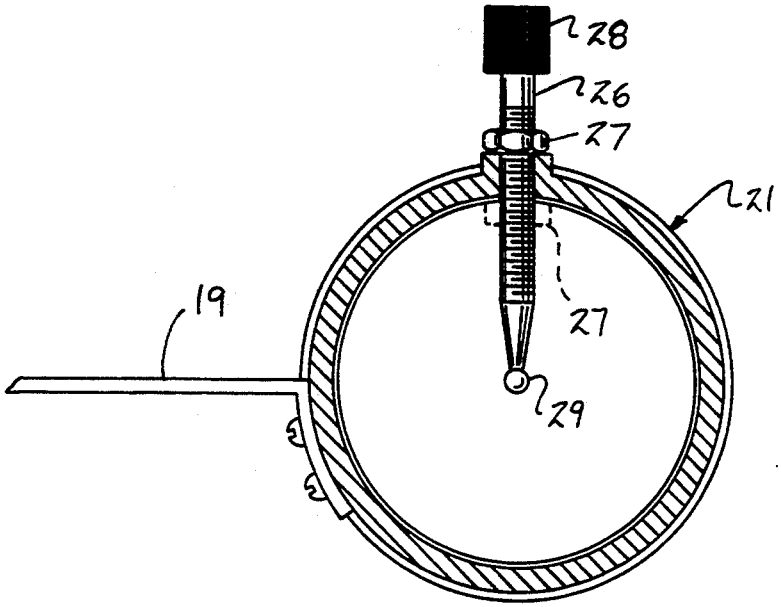
FIG. 4 is an orthographic view, taken along the lines 4—4 of FIG. 2 in the direction indicated by the arrows.

With reference now to the drawings, and in particular to FIGS. 1 to 8 thereof, a new and improved bow sight apparatus embodying the principles and concepts of the present invention and generally designated by the reference numeral 10 will be described.

More specifically, the bow sight apparatus 10 of the instant invention essentially comprises mounting to a bow body 11 by a mounting plate 12. The mounting plate 12 includes coplanar spaced flanges 13 extending in a spaced relationship relative to a mounting plate base 14. A slide plate 15 having spaced tracks 16 slidably receive the flanges 13, with a first lock fastener 17 directed through one of the tracks 16 to engage one of the flanges 13 received within one of the tracks 16. A slide plate flange 18 projects orthogonally relative to the slide plate 15, having a slot 18*a* directed longitudinally thereof. A tube flange 19 is arranged for sliding communication onto the slide plate flange 18 longitudinally aligned therewith, with a second lock fastener 20 directed through the tube flange 19 and received through the slot 18*a* of the slide plate flange 18, with a guide pin 20A spaced from a second lock fastener 20 as the guide pin 20*a* and the second lock fastener 20 are arranged in a parallel relationship relative to one another orthogonally oriented relative to the tube flange 19, as the guide pin 20*a* functions as a guidance and maintaining alignment of the tube flange 19 relative to the slide plate flange 18. A sight tube 21 is fixedly and orthogonally mounted to the tube flange 19. The sight tube 21 includes a first end 23 spaced from a second end 24 symmetrically oriented about an axis 22. A chemiluminescent ring 25 of a translucent material is mounted to the second end 24, with a sighting rod 26 radially directed into the sight tube in adjacency to the first end 23 spaced from the chemiluminescent ring 25. The sighting rod 26 includes a lock fastener 27 threadedly mounted thereabout as the sighting rod 26 is threadedly received through the sight tube 21. Alternatively, inner and outer lock fasteners 27 may be provided onto the threaded sighting rod 26 on opposed sides of the sight tube 21. A sighting rod head 28 is mounted to the sighting rod exteriorly of the sighting tube, with a chemiluminescent sighting sphere 29 made of a translucent material mounted to a distal end of the sighting rod 26 within the sight tube for alignment with the ring 25. In this manner, ease of sighting alignment of the organization is available during periods of limited available light in an archery sighting situation.

The FIGS. 5 and 6 indicate the use of an illumination housing 30 mounted to the sight tube 21 to enhance illumination of the ring 25 and the sphere 29. The illumination housing 30 includes a battery 31 operative through a switch 32 to effect selective illumination of an illumination bulb 33 positioned in adjacency and directed into a transparent lens 34 that receives a fiber optic cable 35 therethrough. The fiber optic cable is notched in a manner to receive illumination into the fiber optic cable and thereby direct illumination through the fiber optic cable into respective fiber optic cable first and second ends, wherein the first end is directed into communication with the translucent chemiluminescent sighting ring 25 and a second end directed into communication with a transparent rod core 36 of the sighting tube 21 (see FIG. 5). The transparent rod core 36 directs illumination through the rod core 36 into the translucent sphere 29.

Figure 7:
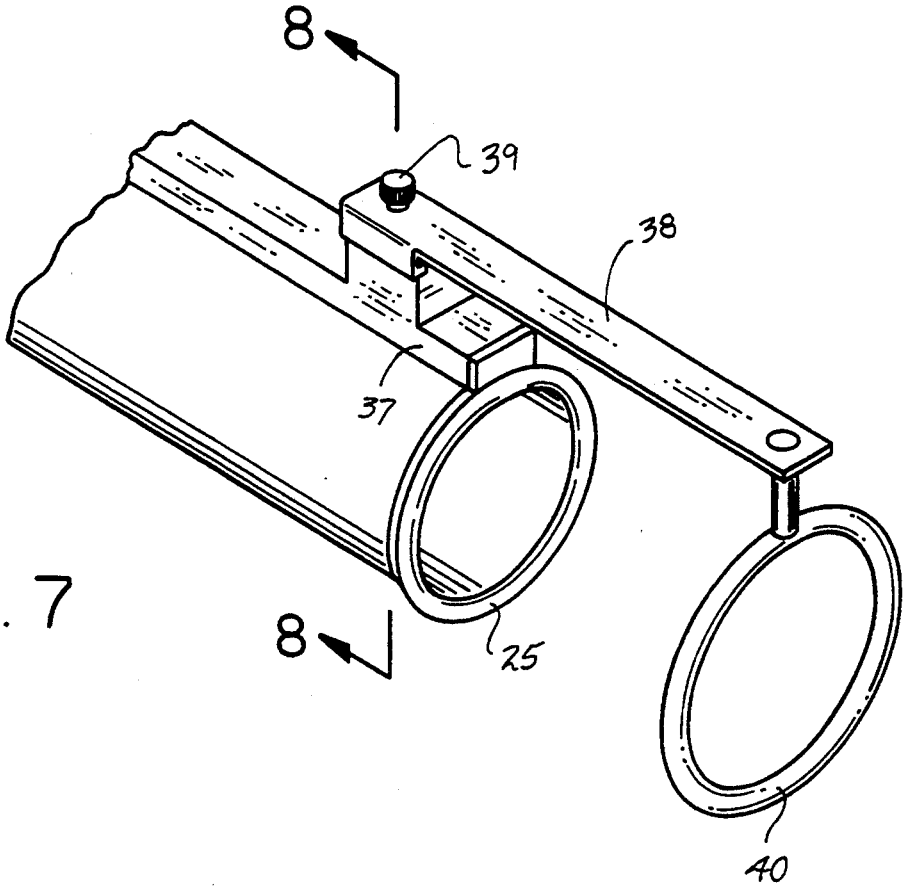
FIG. 7 is an isometric illustration of the modified sighting tube including a further sighting ring.
Figure 8:
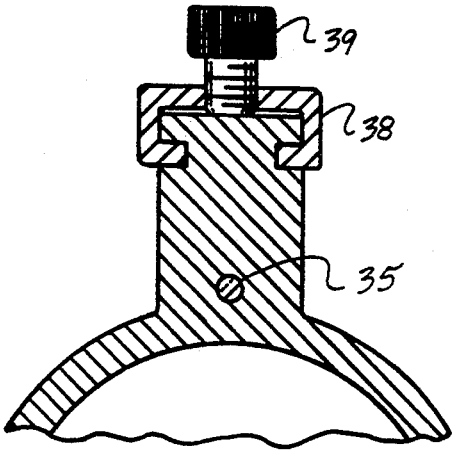
FIG. 8 is an orthographic view, taken along the lines 8—8 of FIG. 7 in the direction indicated by the arrows.

The FIGS. 7 and 8 indicate the further use of a sighting tube boss 37 having a projecting flange 38 that is slidably mounted to the boss 37 by means of a third fastener 39. An outer sighting ring 40 coaxially aligned with the sighting ring 25 is provided, such that the outer sighting ring 40 is also formed of a chemiluminescent material, such that enhanced ease of alignment of the outer ring 40 relative to the ring 25 is available for enhanced rapidity of sighting in use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bow sight apparatus, comprising, a mounting plate, the mounting plate including a mounting plate base, with a plurality of coplanar flanges secured in a spaced relationship relative to a mounting plate base, and a slide plate, the slide plate receiving the coplanar flanges, with a first lock fastener directed through the slide plate into engagement with one of said coplanar flanges to secure the slide plate relative to the coplanar flanges, and a slide plate flange projecting from the slide plate, the slide plate flange including a slot, and a tube flange in contiguous communication with the slide plate flange longitudinally aligned therewith, with the tube flange including a second lock fastener projecting from the tube flange received within the slot, and a guide pin spaced from the second lock fastener, with the guide pin received within the slide plate flange, and a sight tube symmetrically oriented about a sight tube axis, the sight tube fixedly mounted to the tube flange, with the axis orthogonally oriented relative to the tube flange, with the sight tube having a first end spaced from a second end, and a chemiluminescent translucent ring mounted to the second end of the sight tube.

2. An apparatus as set forth in claim 1 including a sighting rod received into the sight tube radially aligned relative to the axis, with the sighting rod having a head member mounted to the sighting rod exteriorly of the sight tube at a second rod first end, and the sighting rod second end including a chemiluminescent translucent sighting sphere arranged for alignment with the ring.

* * * * *